US009443468B2

(12) United States Patent
Kim

(10) Patent No.: US 9,443,468 B2
(45) Date of Patent: Sep. 13, 2016

(54) DISPLAY DEVICE AND CONTROLLER THEREFOR

(71) Applicant: Samsung Display Co., Ltd., Gyeonggi-do (KR)

(72) Inventor: Jin-Woo Kim, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 0 days.

(21) Appl. No.: 14/227,274

(22) Filed: Mar. 27, 2014

(65) Prior Publication Data

US 2014/0312799 A1 Oct. 23, 2014

(30) Foreign Application Priority Data

Apr. 17, 2013 (KR) ..... 10-2013-0042354

(51) Int. Cl.
*G09G 3/32* (2016.01)

(52) U.S. Cl.
CPC .... *G09G 3/3233* (2013.01); *G09G 2300/0866* (2013.01); *G09G 2330/028* (2013.01)

(58) Field of Classification Search
CPC ..... G09G 2330/021; G09G 2330/028; G09G 3/3233; G09G 3/3696; G09G 2320/0233; G09G 2330/02; G09G 3/3291; G09G 2300/0819; H05B 33/0815; H05B 33/0827; H05B 33/0887; H05B 37/02; H05B 33/0896
USPC ..... 345/208, 209, 82, 83, 79, 76, 77; 315/169.1, 169.3, 307, 308, 224
See application file for complete search history.

(56) References Cited

U.S. PATENT DOCUMENTS

2005/0162426 A1 7/2005 Okada
2007/0257645 A1* 11/2007 Nishino ..... H02M 1/32 323/276
2013/0235010 A1* 9/2013 Park ..... 345/209
2013/0241808 A1 9/2013 Kwon et al.

FOREIGN PATENT DOCUMENTS

KR 10-2004-0091660 10/2004
KR 10-2005-0015099 A 2/2005
KR 10-2013-0116411 10/2013

* cited by examiner

*Primary Examiner* — Jany Richardson
(74) *Attorney, Agent, or Firm* — Lee & Morse, P.C.

(57) ABSTRACT

A display device includes a voltage supply unit to output a first voltage, a switch unit to selectively output the first voltage or a second voltage, a coupling member to transfer a third voltage to a display panel, and a feedback unit to selectively feed back the first voltage or the third voltage. The voltage supply unit receives a voltage based on the first voltage or the third voltage selected by the feedback unit, and the third voltage is based on the first voltage output from the switch unit. The voltage supply unit may compensate for drops in a control voltage of the display panel based on the fed back voltage.

20 Claims, 4 Drawing Sheets

DISPLAY DEVICE AND CONTROLLER THEREFOR

CROSS-REFERENCE TO RELATED APPLICATION

Korean Patent Application No. 10-2013-0042354, filed on Apr. 17, 2013, and entitled: "Organic Light Emitting Display Device," is incorporated by reference herein in its entirety.

BACKGROUND

1. Field

One or more embodiments herein relate to a display device, e.g., an organic light emitting display device.

2. Description of the Related Art

Flat panel displays overcome many disadvantages of conventional displays such as cathode ray tubes. One type of flat panel display generates images using organic light emitting diodes that generate light based on the re-combination of electrons and holes in an active layer. While these types of displays operate with high response speeds and lower power, improvements are still required.

SUMMARY

In accordance with one embodiment, a display device includes a display panel; a voltage supply unit configured to output a first voltage; a switching unit configured to selectively output the first voltage from the voltage supply unit or a second voltage; a coupling member configured to transfer a third voltage to the display panel, the third voltage based on the first voltage output from the switching circuit; and a feedback unit configured to selectively feed back the first voltage of the voltage supply unit or the third voltage. The voltage supply unit receives a voltage based on the first voltage or the third voltage selected by the feedback unit.

The feedback unit may feed back the third voltage when the switch unit selects the first voltage, and may feed back the first voltage when the switch unit selects the second voltage. Alternatively, the feedback unit may include a first feedback switch configured to feed back the first voltage; and a second feedback switch configured to feed back the third voltage.

The switch unit may include a first switch and a second switch coupled in series between the voltage supply unit and a source of the second voltage. A turn on period of the first switch and a turn on period of the second switch may not overlap.

The coupling member may be coupled between a common node of the first switch and the second switch and the display panel. The coupling member may generate a voltage drop that reduces the first voltage, and may include a wire, a printed circuit board including but not limited to a flexible printed circuit board, and/or another circuit element that produces a voltage drop.

The display device may include an optional voltage distributing circuit configured to convert the voltage selected by the feedback unit into another voltage for input into the voltage supply unit. When the voltage distributing circuit is included, the feedback unit may include a first feedback switch coupled between an output node of the voltage supply unit and the voltage distributing circuit; and a second feedback switch coupled between a node coupled to an output of the coupling member and the voltage distributing circuit.

The feedback unit may include a multiplexer configured to select the first voltage or the third voltage in response to a control signal. The feedback unit may also include a capacitor between an output of the multiplexer and a predetermined potential. The voltage supply unit may include a DC-DC converter.

The second voltage may be lower than the first voltage, and, for example, may be a ground voltage or another type of reference potential.

The voltage supply unit may control a level of the first voltage in response to the received voltage that is based on the first voltage or the third voltage selected by the feedback unit. The display panel includes one or more organic light emitting pixels (OLEDs).

In accordance with another embodiment, a controller includes a first switch unit to select a first voltage or a second voltage; and a second switch unit to select the first voltage or a third voltage. The first voltage may be a supply voltage, the second voltage may be lower than the supply voltage, and the third voltage may be an output voltage of a coupling member coupled between the first switch unit and a display panel. The second switch unit may be coupled to a power supply circuit which generates the supply voltage.

The second switch unit may select the third voltage when the first switch unit selects the first voltage, and the second switch unit may select the first voltage when the first switch unit selects the second voltage. The third voltage may be lower than the first voltage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
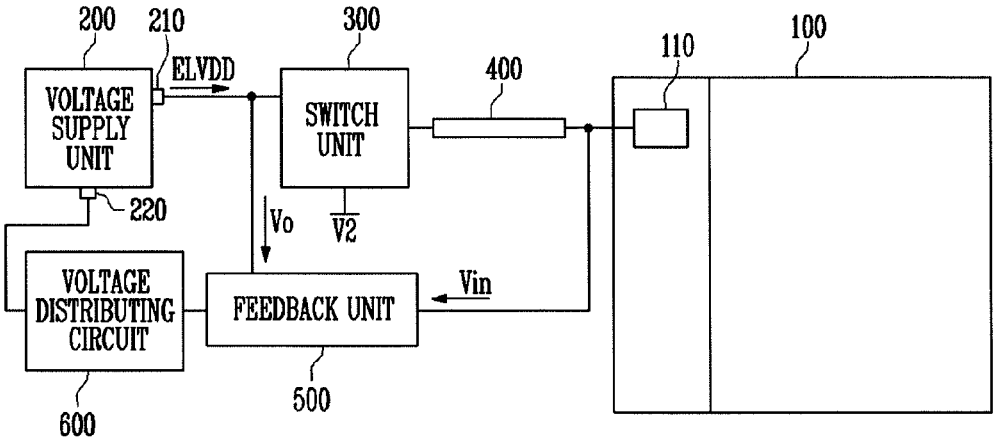
FIG. 1 illustrates an embodiment of an organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete and fully convey exemplary implementations to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of an organic light emitting display device which includes a display panel 100, a voltage supply unit 200, a switch unit 300, a coupling member 400, and a feedback unit 500.

The display panel 100 includes at least one input 110 for receiving a predetermined voltage from an external source and a plurality of pixels 140 (refer to FIG. 2) for displaying an image.

The voltage supply unit 200 may output a first voltage ELVDD through at least one output 210. In addition, the voltage supply unit 200 may be positioned outside the display panel 100 and may supply the first voltage ELVDD to the display panel 100 through the switch unit 300 and the coupling member 400. In other embodiments, the voltage supply unit may be located within the display panel.

Also, the voltage supply unit 200 may be or include a DC-DC converter for converting an external voltage into the first voltage ELVDD. In addition, the voltage supply unit 200 may control a level of the first voltage ELVDD. In one embodiment, the voltage supplying unit may control the level of the first voltage ELVDD to be based on or correspond to a voltage transmitted from the feedback unit 500. For example, the voltage supply unit 200 may control the level of the output first voltage ELVDD in response to a voltage input to a feedback terminal 220.

The switch unit 300 may selectively output the first voltage ELVDD output from the voltage supply unit 200 or a second voltage V2. The second voltage V2 may be supplied from an additional voltage source coupled to the switch unit 300. In addition, a level of the second voltage V2 may be set to be different from the first voltage ELVDD. In one embodiment, the second voltage V2 may be lower than the first voltage ELVDD, e.g., V2 may correspond to a reference or ground voltage. The second voltage V2 may be supplied to the display panel 100 through the switch unit 300 and the coupling member 400.

The switch unit 300 may select and output the first voltage ELVDD in a period where the pixels 140 of the display panel 100 emit light and may select and output the second voltage V2 in a period where the pixels 140 of the display panel 100 do not emit light, for example, in order to reduce power consumption.

The coupling member 400 transmits the voltages output from the switch unit 300 to the input 110 of the display panel 100. In one implementation, the coupling member 400 is coupled between the switch unit 300 and the input 110 of the display panel 100 and includes a wire through which current may flow or a printed circuit board (PCB)d or flexible printed circuit board (FPCB), or both.

The feedback unit 500 receives a voltage Vo of the voltage supply unit 200 and a voltage Vin of the display panel 100 to selectively feedback one of these voltages Vo or Vin to the voltage supply unit 200. When the switch unit 300 selects the first voltage ELVDD for output to the coupling member 400, the feedback unit 500 may feed back voltage Vin of the display panel 100 to the voltage supply unit 200.

With this arrangement, a voltage indicative of an amount of voltage drop caused by the coupling member 400 is fed back to the voltage supply unit 200. Based on this fed back voltage, it is possible to correctly control the level of the first voltage ELVDD for purposes of preventing brightness of the display panel 100 from being deteriorated or otherwise affected.

When the switch unit 300 selects the second voltage V2 for output to the coupling member 400, the feedback unit 500 may feedback the voltage Vo to the voltage supply unit 200. For example, when the second voltage V2, having a lower voltage level than that of the first voltage ELVDD, is supplied to the coupling member 400, the voltage Vo derived from the voltage supply unit 200 may be fed back instead of the voltage Vin of the display panel 100.

A voltage distributing circuit 600 may be included to distribute a voltage, which is based on the voltage output from the feedback unit 500, to the voltage supply unit 200. The voltage distributing circuit 600 may be positioned, for example, between the feedback terminal 220 of the voltage supply unit 200 and the feedback unit 500. Furthermore, the voltage distributing circuit 600 may be included in the organic light emitting display device or may be coupled to this device through an appropriate interface.

In one embodiment, the voltage distributing circuit 600 includes a voltage divider circuit formed from a plurality of resistors R1 and R2. In other embodiments, the voltage distributing circuit 600 may be formed from a distributed resistor network having a plurality of nodes, each outputting a different voltage level based on the voltage fed back from the feedback unit. In still other embodiments, the voltage distributing circuit 600 may be a voltage converter or other processing circuit.

Figure 2:
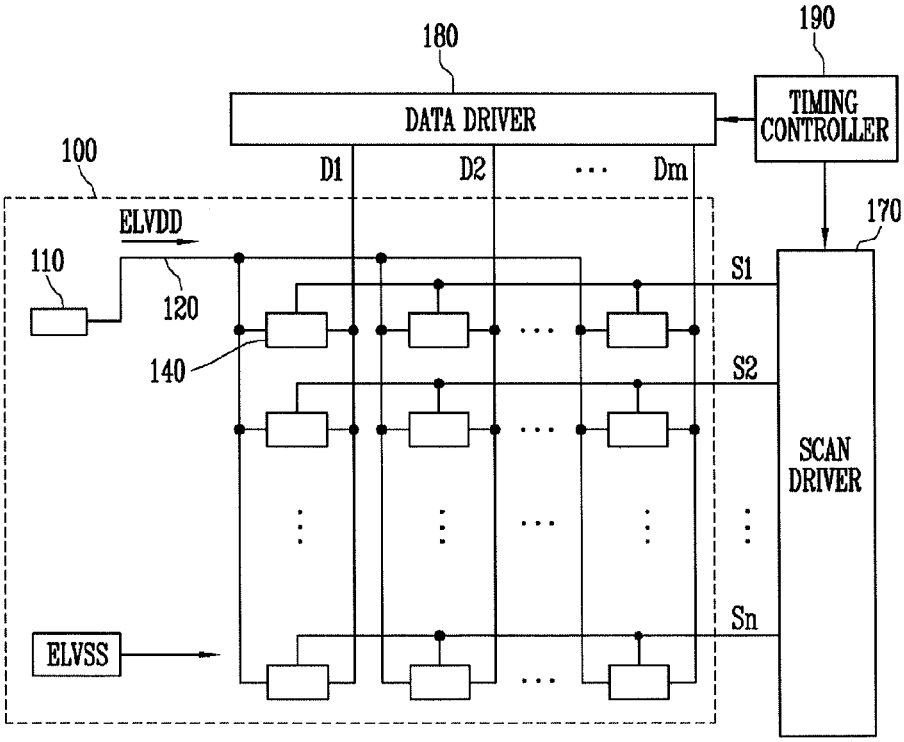
FIG. 2 illustrates an embodiment of a display panel.

FIG. 2 illustrates an embodiment of the display panel 100 which includes a plurality of pixels 140 coupled to scan lines S1 to Sn and data lines D1 to Dm. The display panel 100 may also include the input 110 for receiving a voltage from the coupling member 400 to be supplied to the pixels 140. The input 110 may be electrically coupled to the pixels 140, for example, through a first voltage line 120.

The organic light emitting display device may further include a scan driver 170 for supplying scan signals to the pixels 140 through scan lines S1 to Sn, a data driver 180 for supplying data signals to the pixels 140 through data lines D1 to Dm, and a timing controller 190 for controlling the scan driver 170 and the data driver 180.

The pixels 140, that receive the first voltage ELVDD transmitted through the coupling member 400 and the second voltage ELVSS transmitted in addition to the first voltage ELVDD, may generate light components corresponding to the data signals based on a current that flows from the first voltage ELVDD to the second voltage ELVSS via organic light emitting diodes (OLED) in the pixels.

The scan driver 170 generates the scan signals, based on control of the timing controller 190, for input to the scan lines S1 to Sn. The data driver 180 generates the data signals, based on control of the timing controller 190, for input to the data lines D1 to Dm. When the scan signals are sequentially supplied to the scan lines S1 to Sn, the pixels 140 are sequentially selected by lines and the selected pixels 140 may receive the data signals transmitted from the data lines D1 to Dm.

The scan driver 170, the data driver 180, and the timing controller 190 may be positioned in the display panel 100. For example, the scan driver 170, the data driver 180, and the timing controller 190 may be directly mounted in the display panel 100. In addition, the scan driver 170, the data driver 180, and the timing controller 190 may be provided in the display panel 100 through an additional coupling member (for example, PCB and flexible PCB (FPCB)) from outside of the display panel 100.

Figure 3:
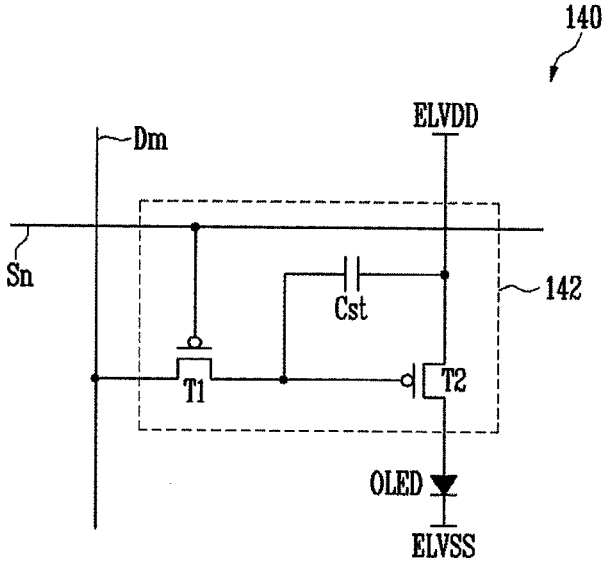
FIG. 3 illustrates an embodiment of a pixel illustrated in FIG. 2.

FIG. 3 illustrates an embodiment of one or more of the pixels illustrated in FIG. 2. Operation of a pixel coupled to the $n^{th}$ scan line Sn and the $m^{th}$ data line Dm will be discussed for illustrative purposes, with the understanding that all or a predetermined number of pixels in the panel may operate in a similar manner.

Referring to FIG. 3, pixel 140 may include an OLED and a pixel circuit 142 coupled to the data line Dm and the scan line Sn to control the OLED. An anode electrode of the OLED is coupled to the pixel circuit 142 and a cathode electrode of the OLED is coupled to the second voltage ELVSS. The OLED may generate light with a brightness which corresponds to an amount of current from the pixel circuit 142.

The pixel circuit 142 controls the amount of current supplied to the OLED to correspond to the data signal supplied to the data line Dm, when the scan signal is supplied to the scan line Sn. In accordance with one embodiment, the pixel circuit 142 includes a second transistor T2 coupled between the first voltage ELVDD and the OLED, a first transistor T1 coupled between the second transistor T2, the data line Dm, and the scan line Sn, and a storage capacitor Cst coupled between a gate electrode and a first electrode of the second transistor T2.

The gate electrode of the first transistor T1 is coupled to the scan line Sn and the first electrode of the first transistor T1 is coupled to the data line Dm. A second electrode of the first transistor T1 is coupled to one terminal of the storage capacitor Cst. The first electrode is one of a source electrode or a drain electrode, and the second electrode is the other of a source electrode or a drain electrode. For example, when the first electrode is a source electrode, the second electrode is a drain electrode.

The first transistor T1 is turned on when the scan signal is supplied from the scan line Sn. When the first transistor turns on, the data signal is supplied from the data line Dm to a node coupled to the storage capacitor Cst. As a result, the storage capacitor Cst charges to a voltage based on the data signal.

A gate electrode of the second transistor T2 is coupled to one terminal of the storage capacitor Cst through the aforementioned node, and a first electrode of the second transistor T2 is coupled to the other terminal of the storage capacitor Cst and the first voltage ELVDD. A second electrode of the second transistor T2 is coupled to the anode electrode of the OLED.

The second transistor T2 controls an amount of current that flows from the first voltage ELVDD to the second voltage ELVSS via the OLED. The amount of current that flows corresponds to a value of a voltage stored in the storage capacitor Cst. The OLED generates light corresponding to the amount of current supplied from the second transistor T2.

The embodiment of the pixel 140 in FIG. 3 is but one of many types of pixel configurations that may be implemented in display panel 100. For example, the pixel circuit in the pixel 140 illustrated in FIG. 3 has two transistors and one capacitor. The two transistors operate as switching and driving transistors. In other embodiments, the pixel circuit 142 may include one or more additional transistors and/or capacitors, for example, to control the timing and/or amount of current supplied to the OLED. Some of these transistors or capacitors may, for example, compensate for variations in threshold voltage of the driving transistor, while other transistors or capacitors may be provided to be consistent the number and/or type(s) of control and driver lines included in the particular display panel implementation.

Referring again to FIG. 3, the second voltage ELVSS supplied to each of the pixels 140 may be generated by an additional voltage supply unit. The second voltage ELVSS may be a reference potential, including but not limited to ground, or another predetermined voltage that is less than ELVDD, if the transistors are implemented using PMOS technology. According to one embodiment, the first voltage ELVDD may be a positive voltage and the second voltage ELVSS may be a negative voltage. The second voltage ELVSS may be supplied to each of the pixels 140 by the same method as that of the first voltage ELVDD or a different method.

Figure 4:
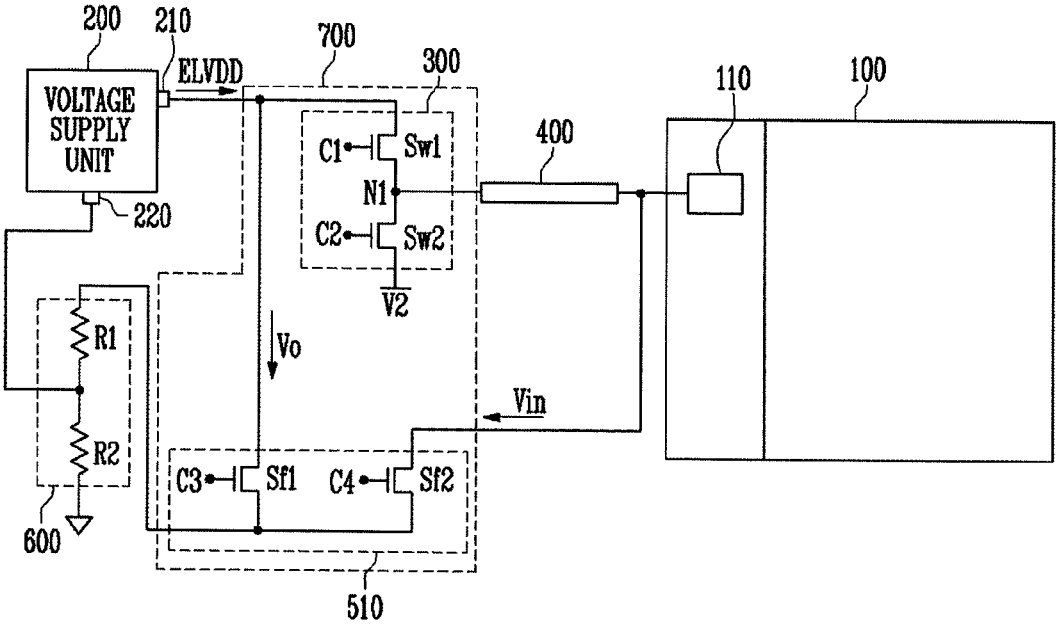
FIG. 4 illustrates a first embodiment of an organic light emitting display device.

FIG. 4 illustrates a first embodiment of an organic light emitting display device, in which switch unit 300 includes a first switch Sw1 and a second switch Sw2. The first switch Sw1 and the second switch Sw2 may be coupled in series between the output 210 of the voltage supply unit 200 and the second voltage V2.

The coupling member 400 is coupled between a common node N1, which is between the first switch Sw1 and the second switch Sw2, and the input 110 of the display panel 100. The first switch Sw1 may be realized by a transistor, and the on and off states of the first switch Sw1 may be controlled by a first control signal C1 input to a control electrode of the transistor.

The second switch Sw2 may also be realized by a transistor, and the on and off states of the second switch Sw2 may be controlled by a second control signal C2 input to the control electrode of this transistor. In other embodiments, the first switch SW1 may be formed from a diode or another type of switching circuit.

The first control signal C1 and the second control signal C2 may be supplied from the timing controller 190. In the switch unit 300, the first switch Sw1 is turned on and the second switch Sw2 is turned off to transmit the first voltage ELVDD from the voltage supply unit 200 to the coupling member 400. Conversely, the first switch Sw1 turns off and the second switch Sw2 turns on to transmit the second voltage V2 to the coupling member 400.

Referring to FIG. 4, a feedback unit 510 may include a first feedback switch Sf1 configured to feed back the voltage Vo of the voltage supply unit 200 and a second feedback switch Sf2 configured to feed back the voltage Vin of the display panel 100. The first feedback switch Sf1 may be realized by a transistor, and the on an off states of the first feedback switch Sf1 may be controlled by a third control signal C3 input to the control electrode. The second feedback switch Sf2 may also be realized by a transistor, and the on an off states of the second feedback switch Sf2 may be controlled by a fourth control signal C4 input to the control electrode. The third control signal C3 and the fourth control signal C4 may be supplied from the timing controller 190. Like in switch unit 300, feedback switches Sf1 and Sf2 may be formed by a diode or a different type of switch unit in other embodiments. In FIG. 4, the switch unit 300 and the feedback unit 510 may be considered to form or be included in a controller 700.

In operation, the first feedback switch Sf1 turns on and the second feedback switch Sf2 turns off to feed back the voltage Vo of the voltage supply unit 200 to the voltage supply unit 200. Conversely, the first feedback switch Sf1 turns off and the second feedback switch Sf2 turns on to feedback the voltage Vin of the display panel 100 to the voltage supply unit 200.

The voltage distributing circuit 600 may be considered to be an optional feature in some embodiments. In such a case, the voltage output from the feedback unit 500 may not be divided, but rather input directly into the voltage supply unit 200.

When the voltage distributing circuit 600 is provided between the voltage supply unit 200 and the feedback unit 510, the first feedback switch Sf1 may be coupled between the output 210 of the voltage supply unit 200 and the voltage distributing circuit 600 and the second feedback switch Sf2 may be coupled between the input 110 of the display panel 100 and the voltage distributing circuit 600.

When the voltage distributing circuit includes a two-resistor voltage divider, the voltage distributing circuit 600 divides a voltage from the feedback unit 510 through the internal resistors R1 and R2 and supplies the divided voltage to the feedback terminal 220 of the voltage supply unit 200.

When the voltage distributing circuit 600 does not exist, the first feedback switch Sf1 may be coupled between the output 210 of the voltage supply unit 200 and the feedback terminal 220 of the voltage supply unit 200 and the second feedback switch Sf2 may be coupled between the input 110 of the display panel 100 and the feedback terminal 220 of the voltage supply unit 200.

Figure 5:
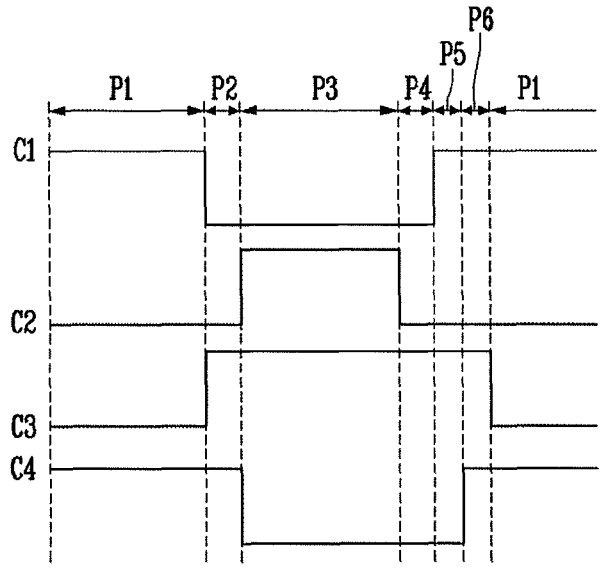
FIG. 5 is a waveform diagram illustrating a driving operation of the organic light emitting display device illustrated in FIG. 4.

FIG. 5 is a waveform diagram illustrating a driving operation of the organic light emitting display device illustrated in FIG. 4. Referring to FIG. 5, in a first period P1, the first switch Sw1 of the switch unit 300 is set to the on state and the second switch Sw2 is set to the off state. To achieve this switching configuration, the first control signal C1 is at a high level and the second control signal C2 is at a low level.

In addition, in the first period P1, the first feedback switch Sf1 is set to the off state and the second feedback switch Sf2 is set to the on state. To achieve this switching configuration, the third control signal C3 is at a low level and the fourth control signal C4 is at a high level.

Therefore, in the first period P1, the first voltage ELVDD may be supplied to the input 110 of the display panel 100 and the input voltage Vin into the display panel 100 is fed back to the voltage supply unit 200.

In a second period P2, the first switch Sw1 and the second switch Sw2 are set to the off state. To achieve this switching configuration, the first control signal C1 and the second control signal C2 are at low levels.

In addition, in the second period P2, the first feedback switch Sf1 and the second feedback switch Sf2 are set to the on state in order to prevent a feedback voltage from rapidly changing. To achieve this switching configuration, the third control signal C3 and the fourth control signal C4 are at high levels.

In a third period P3, the first switch Sw1 is set to the off state and the second switch Sw2 is set to the on state. To achieve this switching configuration, the first control signal C1 is at the low level and the second control signal C2 is at the high level. In addition, in the third period P3, the first feedback switch Sf1 is set to the on state and the second feedback switch Sf2 is set to the off state. To achieve this switching configuration, the third control signal C3 is at the high level and the fourth control signal C4 is at the low level.

Therefore, in the third period P3, the second voltage V2 may be supplied to the input 110 of the display panel 100 and the output voltage Vo of the voltage supply unit 200 may be fed back to the voltage supply unit 200.

In a fourth period P4, the first switch Sw1 and the second switch Sw2 are set to the off state. To achieve this switching configuration, the first control signal C1 and the second control signal C2 are at low levels. In addition, in the fourth period P4, the first feedback switch Sf1 is set to the on state and the second feedback switch Sf2 is set to the off state. To achieve this switching configuration, the third control signal C3 is at the high level and the fourth control signal C4 is at the low level. Therefore, in the fourth period P4, the output voltage Vo of the voltage supply unit 200 may be fed back to the voltage supply unit 200.

In a fifth period P5, the first switch Sw1 may be set to the on state and the second switch Sw2 is set to the off state. To achieve this switching configuration, the first control signal C1 is at a high level and the second control signal C2 in at a low level. In addition, in the fifth period P5, the first feedback switch Sf1 is set to the on state and the second feedback switch Sf2 is set to the off state. To achieve this switching configuration, the third control signal C3 in at the high level and the fourth control signal C4 is at the low level.

In a sixth period P6, the first switch Sw1 is set to the on state and the second switch Sw2 is set to the off state. To achieve this switching configuration, the first control signal C1 is at the high level and the second control signal C2 is at the low level.

In addition, in the sixth period P6, the first feedback switch Sf1 and the second feedback switch Sf2 are set to the on state in order to prevent the feedback voltage from rapidly changing. To achieve this switching configuration, the third control signal C3 and the fourth control signal C4 are at the high level. After the sixth period P6, the above-described first period P1 may proceed again.

Figure 6:
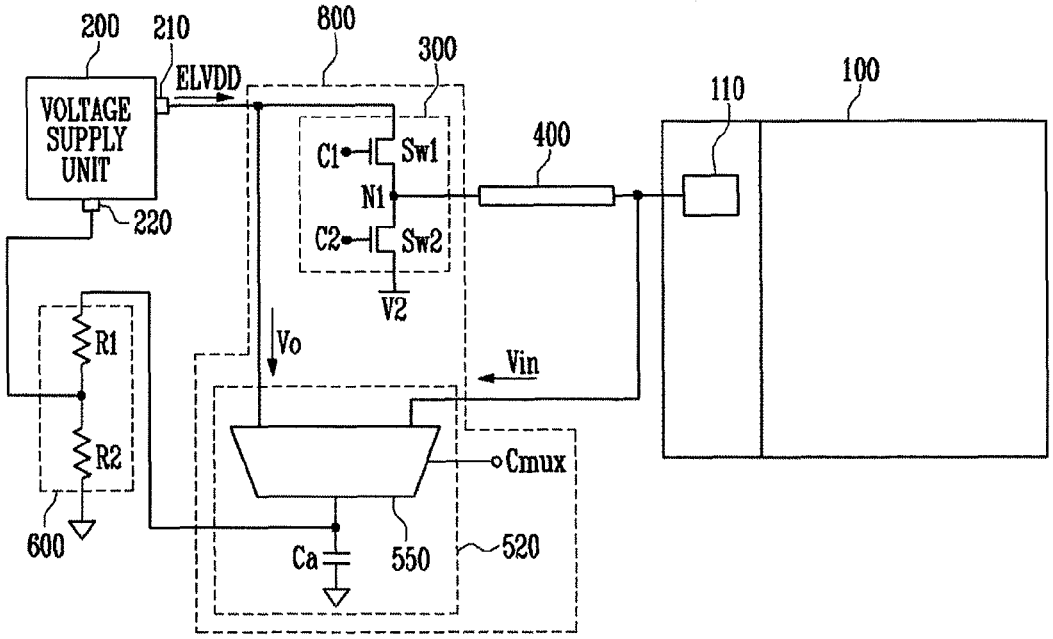
FIG. 6 illustrates a second embodiment of an organic light emitting display.

FIG. 6 illustrates a second embodiment of an organic light emitting display device. Unlike FIG. 5, the second embodiment includes a feedback unit 520 equipped with or coupled to a multiplexer 550.

The multiplexer 550 may receive the output voltage Vo of the voltage supply unit 200 and the input voltage Vin of the display panel 100, and may select the output voltage Vo or the input voltage Vin based on a control signal Cmux. This control signal may be received from an external source such as a controller or processor.

When the control signal Cmux is at a low level, the multiplexer 550 may select the output voltage Vo of the voltage supply unit 200 to be fed back to the voltage supply unit 200. When the control signal Cmux is at a high level, the multiplexer 550 may select the input voltage Vin of the display panel 100 to be fed back to the voltage supply unit 200. In FIG. 6, the switch unit 300 and the feedback unit 520 may be considered to form or be included in a controller 800.

Like in the first embodiment, the voltage distributing circuit 600 is an optional feature. When the voltage distributing circuit 600 is included between the voltage supply unit 200 and the feedback unit 520, an output signal of the multiplexer 550 may be coupled to the input of the voltage distributing circuit 600.

In addition to these features, the feedback unit 520 may include an auxiliary capacitor Ca coupled to an output node of the output of the multiplexer 550. The capacitor may operate as a smoothing or filtering capacitor, and/or may prevent rapid swings in voltage at least at the time the selected signal to be fed back changes. When the voltage distributing circuit 600 is not included, the output of the multiplexer 550 may be directly coupled to the feedback terminal 220 of the voltage supply unit 200.

Figure 7:
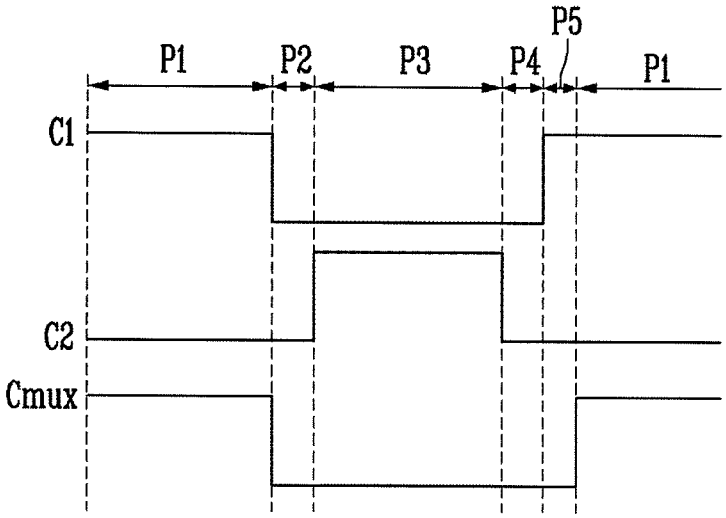
FIG. 7 is a waveform diagram illustrating a driving operation of the organic light emitting display device illustrated in FIG. 6.

FIG. 7 is a waveform diagram illustrating a driving operation of the organic light emitting display device illustrated in FIG. 6. Referring to FIG. 7, in the first period P1, the first switch Sw1 of the switch unit 300 is set to the on state and the second switch Sw2 is set to the off state. To achieve this switching configuration, the first control signal C1 is at the high level and the second control signal C2 is at the low level.

In addition, in the first period P1, the multiplexer 550 in the feedback unit 520 selects the input voltage Vin of the display panel 100 to be fed back to the voltage supply unit 200. For this purpose, the control signal Cmux is at the high level. Therefore, in the first period P1, the first voltage ELVDD may be supplied to the input 110 of the display panel 100 and the input voltage Vin of the display panel 100 may be fed back to the voltage supply unit 200.

In the second period P2, the first switch Sw1 and the second switch Sw2 are set to the off state. To achieve this switching configuration, the first control signal C1 and the second control signal C2 are at the low level. In addition, in the second period P2, the multiplexer 550 selects the output voltage Vo of the voltage supply unit 200 to be fed back to the voltage supply unit 200.

In the third period P3, the first switch Sw1 is set to the off state and the second switch Sw2 is set to the on state. To achieve this switching configuration, the first control signal C1 is at the low level and the second control signal C2 is at the high level. In addition, in the third period P3, the multiplexer 550 selects the output voltage Vo of the voltage supply unit 200 to be fed back to the voltage supply unit 200. Therefore, in the third period P3, the second voltage V2 is supplied to the input 110 of the display panel 100 and the output voltage Vo of the voltage supply unit 200 is fed back to the voltage supply unit 200.

In the fourth period P4, the first switch Sw1 and the second switch Sw2 are set to the off state. To achieve this switching configuration, the first control signal C1 and the second control signal C2 are at the low level. In addition, in the fourth period P4, the multiplexer 550 selects the output voltage Vo of the voltage supply unit 200 to be fed back to the voltage supply unit 200.

In the fifth period P5, the first switch Sw1 is set to the on state and the second switch Sw2 is set to the off state. To achieve this switching configuration, the first control signal C1 is at the high level and the second control signal C2 is at the low level may be supplied to the second switch Sw2. In addition, in the fifth period P5, the multiplexer 550 selects the output voltage Vo of the voltage supply unit 200 to be fed back to the voltage supply unit 200. After the fifth period P5, the above-described first period P1 may proceed again.

The foregoing embodiments have been described in the context of a display panel having organic light emitting diode pixels. In other embodiments, the devices shown in FIGS. 4 and 6 may be applied to display panels having different types of pixels, such as but not limited to liquid crystal display pixels. Also, in the foregoing embodiments, the control signals C1, C2, C3, C4, and Cmux may be generated by the timing controller 190 and/or another control circuit located within or coupled to the display panel.

By way of summation and review, an organic light emitting display device has a display panel that includes a plurality of pixels which collectively display an image, and a voltage supply unit to supply a voltage to the display panel. The voltage supply unit generates voltages for input to the display panel. In operation, a feedback unit selects an input voltage into the display panel or an output voltage of the voltage supply unit for input into the supply unit, based on different operational periods of the panel.

As a result, the voltage display unit may detect and/or compensate for a voltage drop generated by intervening circuitry (e.g., a PCB or FPCB) located between the display panel and the voltage supply unit, which voltage drop may affect (e.g., lower) the level of input voltage into the panel for driving the display pixels. Put differently, the intervening circuitry may cause an unintended lower voltage to be input into the panel, which lower voltage may adversely affect brightness and/or other performance parameters.

As described above, according to one or more embodiments, it is possible to provide an organic light emitting display device which is capable of correctly controlling the output voltage and preventing the brightness of the display panel from being deteriorated.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel;

a voltage supply to output a first voltage;

a switch circuit to selectively output the first voltage from the voltage supply or a second voltage;

a coupler to output a third voltage to the display panel, the third voltage based on the first voltage output from the switch circuit; and a feedback circuit to selectively feed back the first voltage of the voltage supply or the third voltage, the voltage supply to receive a voltage, based on the first voltage or the third voltage selected by the feedback circuit, through a signal path between the feedback circuit and the voltage supply.

2. The display device as claimed in claim 1, wherein the feedback circuit:

feeds back the third voltage when the switch circuit selects the first voltage, and feeds back the first voltage when the switch circuit selects the second voltage.

3. The display device as claimed in claim 1, wherein the switch circuit comprises a first switch and a second switch coupled in series between the voltage supply and a source of the second voltage.

4. The display device as claimed in claim 3, wherein the coupler is coupled between a common node of the first switch and the second switch and the display panel.

5. The display device as claimed in claim 3, wherein a turn on period of the first switch and a turn on period of the second switch do not overlap.

6. The display device as claimed in claim 3, wherein the feedback circuit includes:

a first feedback switch to feed back the first voltage; and a second feedback switch to feed back the third voltage.

7. The display device as claimed in claim 1, further comprising: a voltage distributing circuit to convert the voltage selected by the feedback circuit into another voltage for input into the voltage supply.

8. The display device as claimed in claim 7, wherein the feedback circuit comprises:

a first feedback switch coupled between an output node of the voltage supply and the voltage distributing circuit; and a second feedback switch coupled between a node coupled to an output of the coupler and the voltage distributing circuit.

9. The display device as claimed in claim 1, wherein the feedback circuit comprises a multiplexer configured to select the first voltage or the third voltage in response to a control signal.

10. The display device as claimed in claim 9, wherein the feedback circuit further comprises a capacitor between an output of the multiplexer and a predetermined potential.

11. The display device as claimed in claim 1, wherein the voltage supply includes a DC-DC converter.

12. The display device as claimed in claim 1, wherein the second voltage is lower than the first voltage.

13. The display device as claimed in claim 1, wherein the second voltage is a ground voltage.

14. The display device as claimed in claim 1, wherein the voltage supply controls a level of the first voltage in response to the received voltage that is based on the first voltage or the third voltage selected by the feedback circuit.

15. The display device as claimed in claim 1, wherein the coupler generates a voltage drop that reduces the first voltage.

16. The display device as claimed in claim 15, wherein the coupler is at least one of a wire or a printed circuit board (PCB).

17. The display device as claimed in claim 1, wherein the display panel includes one or more organic light emitting pixels (OLEDs).

18. A controller, comprising:

a switch circuit to select a first voltage or a second voltage; and a feedback circuit to select the first voltage or a third voltage, wherein the first voltage is a supply voltage, the second voltage is lower than the supply voltage, and the third voltage is an output voltage of a coupler coupled between the switch circuit and a display panel, and wherein the feedback circuit is coupled to a power supply circuit which generates the supply voltage.

19. The controller as claimed in claim 18, wherein:

the feedback circuit selects the third voltage when the switch circuit selects the first voltage, and the feedback circuit selects the first voltage when the switch circuit selects the second voltage.

20. The controller as claimed in claim 18, wherein the third voltage is lower than the first voltage.

* * * * *